United States Patent [19]

Poyda

[11] Patent Number: 4,966,492

[45] Date of Patent: Oct. 30, 1990

[54] FLEXIBLE SEALING SHEET

[75] Inventor: Frank Poyda, Erftstadt, Fed. Rep. of Germany

[73] Assignee: Dynamit Nobel Aktiengesellschaft, Troisdorf, Fed. Rep. of Germany

[21] Appl. No.: 384,076

[22] Filed: Jul. 24, 1989

Related U.S. Application Data

[63] Continuation of Ser. No. 101,434, Sep. 28, 1987, abandoned.

[30] Foreign Application Priority Data

Sep. 27, 1986 [DE] Fed. Rep. of Germany ..... 3632951
May 2, 1987 [DE] Fed. Rep. of Germany ..... 87106340

[51] Int. Cl.[5] ..... E02D 31/00

[52] U.S. Cl. ..... 405/128; 405/50; 405/270; 405/38

[58] Field of Search ..... 405/38, 43, 50, 128, 405/129, 270

[56] References Cited

U.S. PATENT DOCUMENTS 2,378,239 6/1945 Myron ..... 405/43 X
4,246,305 1/1981 Delattre ..... 405/50 X
4,565,468 1/1986 Crawford ..... 405/270
4,622,138 11/1986 Wager ..... 405/50 X
4,624,604 11/1986 Wagner et al. ..... 405/128
4,697,954 10/1987 Grund ..... 405/128

FOREIGN PATENT DOCUMENTS 3502981 7/1986 Fed. Rep. of Germany ..... 405/128

*Primary Examiner*—David H. Corbin
*Attorney, Agent, or Firm*—Antonelli, Terry, Stout & Kraus

[57] ABSTRACT

A flexible sealing sheet for controllably leakproof separation of the regions present on both sides thereof, especially for the sealing of rubbish dumps, which exhibits, in at least one plane, hollow channels extending essentially in the longitudinal extension of the sheet and separated from one another by channel walls. The hollow channels permit, with the sealing sheet already installed, an inspection with respect to possible leakage. It is furthermore possible, by selective injection of appropriate sealing media into the hollow channels to subsequently repair defective portions of the sealing sheets.

16 Claims, 5 Drawing Sheets

FLEXIBLE SEALING SHEET

This application is a continuation of application Ser. No. 101,434, filed Sept. 28, 1987, now abandoned.

BACKGROUND OF THE INVENTION

This invention relates to a flexible sealing (waterproofing) sheet for effecting controllable leakproof separation of regions separated by the sheet, and also to a method for controlling leakproof separation of the regions present on both sides of the flexible sealing sheet.

Flexible sealing sheets of the type to which this invention pertains are utilized predominantly for the sealing of rubbish dumps or waste deposits. The sheets are joined to form a larger, liquid-tight barrier, for example, by welding or gluing; this barrier separating the body of the fill (for example waste) from the ground in order to avoid contamination of the groundwater.

In the conventional sealing (proofing) constructions, polymeric sealing sheets or mineral sealing layers (clay barrier) are the choice material. Normally, in case of a simple arrangement (so-called standard proofing system), there is no possibility of checking of the barrier for leakage.

In a so-called maximum proofing system, a second seal (control barrier) is laid underneath the main barrier. Between the two barrier planes, a drainage system is located terminating with a inclination (gradient) into a vertical inspection shaft. In case of leaks in the top barrier plane (primary seal), the waste seepage (eluate) flows through the draining conduits to the vertical inspection shaft. In order to repair a possible leak, an injection medium can be forced into the drainage system from the inspection shaft. This process cannot provide a controlled injection and repair of the leakage, and it is not possible to execute a subsequent inspection of the repair and thus of the functional efficacy of the sealing system. Furthermore, this multi-layer seal requires a high expenditure during installation.

DOS 3,432,642 A 1 (Δ WO86101554) discloses a seal of this type wherein a spacer having a continuous area is arranged in the interspace between two solid films, this spacer having flow cross sections that are open in all directions in parallel to the extension of the films. This seal makes it possible to detect a leak in the top film by determining from a sampling site any eluate that has penetrated into the interspace between the two films. In this conventional sealing layer, each location of the intermediate layer is hydraulically connected to every other location of the intermediate layer so that the position of a leak cannot be determined.

With the sealing barrier according to DOS 3,432,642 A 1 it is possible, in the case of a leakage, to fill the interspace between the films with materials which absorb or destroy any pollutants that may have entered and thereby render them harmless in such a way that they cannot migrate from the material in the direction toward the ground zone to be protected.

A controlled repair of such a defective seal, for example, by filling a sealing medium into the intermediate layer, would, however, negate the ability to inspect the entire sealing barrier. Furthermore, the reliable distribution of a sealing compound in the entire interspace in parallel to the film extension is very expensive. For these reasons, sealing barriers according to DOS 3,432,642 A 1 could not heretofore be repaired, i.e. made leakproof, in case of leakage.

Another publication (Verband der Chemischen Industrie e.V. [Chemical Industrial Society, registered association], work prepared by the team "Waste Management" of the committee on waste disposal, entitled: "Further Development of Subsoil Leakproofing of Special Waste Dumps", October 1985) describes a dump barrier wherein a control drainage of gravel is utilized between two seals. In the control drainage layer, drainage pipes are installed directly above the bottom seal. In the center of the control drainage layer, pipes with bores are built for the introduction of sealing slurries (cementing agents) in case of a detected leak.

By subdividing the entire area of the dump into sections, the objective is attained that in case of a detected leakage, it is possible to repair, respectively, one grid section without impairing the control possibilities of the other sections. The subdivision of the dump area into compartmental areas, however, entails considerable technical expenditure since the sections must be individually sealed off and each section must be equipped with its own drainage system with pipe connections.

Furthermore, in this system, in case of a leak and a subsequent repair of the compartmental sector by injection of sealing slurries, it is impossible to check on the success of the repairs or to determine subsequently a renewed occurrence of leakage in this grid sector.

Therefore, the invention is based on the object of providing a flexible sealing sheet having a structure such that a precise controllability is thus created with regard to any occurring leakages which, if needed, can be repaired in a simple way without restricting the controllability of neighboring regions. It is furthermore an object of the invention to provide a method for effecting a controllable leakproof separation of the regions present on both sides of a flexible sealing sheet, as well as for the repair of leakages of the sealing sheet.

The invention attains this object by a (waterproofing) sealing sheet which exhibits, in at least one plane, hollow channels, extending essentially in the longitudinal direction (or extension) of the sheet and being separated from one another by channel walls.

The structure of the sealing sheet according to the invention with a layer (plane) of mutually bulkheaded hollow channels, for example, small tubular channels, makes it possible to determine a leak by exiting eluate from a defective hollow channel and to locate the leak approximately. Accordingly, a defective sealing sheet can be repaired by injecting a sealing compound into the defective hollow channel and, for example, curing such compound. Since the repair can be limited to the defective hollow channel (channels), the controllability of all other hollow channels is still ensured.

It is especially advantageous to use two sealing sheets according to the invention in two plies one above the other, wherein the bottom sealing sheet permits control of the leakproof status of the top sealing sheet even in case of a repair of the top sealing sheet. Controllability thus is ensured also at the repaired location of the top sealing sheet.

In accordance with a preferred structure of the sealing sheet, the sheet exhibits at least two planes (strata) of hollow channels. This provides the effect that the uppermost plane of hollow channels serves as a control layer which, in case of leakage, permits a repair, for example, by filling with a sealing compound; whereas the (at least one) further plane of hollow channels ensures control of the repair as well as the further control of the flexible sealing sheet at the repaired site.

Preferably, the hollow channels have a round cross section since thereby an optimum ratio between stability and use of material is ensured. However, it is also possible to use hollow channels having a polyhedral cross section, etc., especially a honeycomb shape. The proportion of cavities to cavity walls must be set so that the sealing sheet when used as intended is not compressed by the load lying thereon to such an extent that the hollow channels are closed.

Preferable, the sheet exhibits channels with a diameter of 2–10 mm, more preferable of 4–6 mm in the cross section and a total thickness of 5–12 mm in case of a flexible sealing sheet exhibiting hollow channels in one plane and a total thickness of 10–15 mm if it exhibits hollow channels in two planes.

According to the invention, the sealing sheet exhibits preferably along both longitudinal rims, i.e. in parallel to the extension of the hollow channels, respectively one lateral strip for the fluid-tight connection of several sealing sheets. This lateral strip can likewise comprise hollow channels in, for example, one plane in order to attain complete controllability and repairability even in the region of the weld seams. However, preferably the lateral strips are made without hollow channels or cavities. This has the advantage that the individual sheets can be welded together more completely since the hollow channels would prevent a uniform pressure distribution in the welding zone.

Furthermore, the advantage is thus obtained of being able to weld the individual sheets together by using conventional apparatus.

The weld seams are preferably achieved as double seams; a narrow, seamless interspace remaining between two parallel longitudinal seams. This seamless interspace serves, after welding, for testing the tightness of both weld seams.

The sealing sheet of this invention preferably exhibits on both sides, respectively, one smooth layer devoid of hollow spaces and having a thickness of at least 0.5 mm. This layer, depending on the embodiment, can consist of the same material as the central layer exhibiting the hollow channels, but if desired the cover layers can also consist of materials that are especially impervious or that are fiber-reinforced.

The sealing sheet according to the invention is preferably manufactured from a thermoplastic synthetic resin by extrusion. In this process, a homogeneous, one-piece sealing sheet is obtained, the length of which is merely limited by the transportation facilities available. The length of the sheets thus can be adapted, in case of relatively small dumps, to the fill dimension without having to join several sealing sheets with one another along the end faces. Therefore, in order to seal relatively small rubbish dumps, it can be sufficient to connect several sealing sheets along their longitudinal rims to form a correspondingly large sealing barrier (waterproofing membrane system).

The sealing sheets of this invention can be tested for leakages by simple measures:

When using the sealing sheet, for example, in solid waste dumps, dump water or eluate seeps, in case of a leakage, at the end face of the sealing sheet, i.e. at the end of the hollow channels, from those hollow channels in communication with the surface of the sealing sheet due to damage to the sealing sheet. Optionally, it is also possible to detect a leakage by blowing in, e.g., compressed air and measuring the pressure loss in the individual hollow channels.

According to the invention, the individual hollow channels are mutually sealed off by the channel walls. Thereby, a precise determination of the position of leaks is possible since in each case only the damaged hollow channels conduct, for example, eluate. Also, the repair in case of leakage can be restricted to individual hollow channels and thus, kept to a small area. The hollow channels in the at least one further layer, according to a preferred embodiment of the invention, serve in this arrangement for controlling the repair as well as for an additional controlling of the sealing sheet after repair.

When sealing relatively large dumps, the length of the sealing sheets of this invention, limited especially by the transportation capacity, will not be sufficient for providing a liquid-tight barrier for the entire dump. In these cases, several sealing sheets according to this invention can also be used, flanged together along their end faces.

However, according to an embodiment of this invention, the provision is preferably made in these instances to join several waterproofing sealing sheets along their longitudinal rims into one waterproofing membrane system, wherein this membrane system inspection gallery is arranged at the end face of this waterproofing membrane system where the individual sealing sheets terminate with their end faces. Thereby, an end-face flanging together of several sealing sheets is superfluous.

The—preferably horizontally extending—inspection gallerys which later on are located underneath the sanitary fill provide access to the individual ends of the hollow channels and thus a checking of the waterproofing membrane system. In correspondence with the length of the dump, one or several such inspection gallerys can be provided.

A preferred proofing construction with the use of the sealing sheet of this invention is constituted by one or several inspection gallerys and a large-surface seal lying essentially between the inspection tunnels. In this arrangement, the large-surface seal consists normally, from the bottom toward the top, of: a supporting layer, a protective layer, a lower flexible sealing sheet with hollow channels, an upper flexible sealing sheet with hollow channels, an additional sealing barrier, a protective layer, as well as an upper protective layer. The rubbish or waste material comes to lie on top of this arrangement.

For the sealing of a planned rubbish dump, a basin-like pit for the subsequent dump is first of all excavated. In the throat zone between the floor and the slope and optionally on the floor, there extend substantially parallel inspection tunnels, for example, at a spacing of about 60 to 100 meters, the ends of the inspection tunnels being continued respectively up to the rim of the dump. From portals, the tunnels can later on be entered and the barrier can be checked for leaks.

The inspection tunnels consist, for example, of a floor section and a ridge section. The floor sections are poured onto the subgrade, for example, by cast-in-place concrete. A supporting layer is built up between the tunnel and in the zone of the slopes, which layer is compacted and graded. On this is laid a protective layer (for example, a protective mat) which terminates in each case at the wall of the inspection tunnel. The mat strips are in mutually overlapping relationship along a width of at least 5 cm.

On this protective layer, a first layer of flexible sealing sheets exhibiting hollow channels in one plane is installed. The individual sheets are, in this step, spread out with their lateral strips overlapping and are thermally welded together along the lateral strips. During the welding process, the surfaces are heated to the melting or fusing point of the material and joined under pressure. This welding procedure takes place preferably in the form of a double seam. Thereby, the possibility is provided to test the bond, with the aid of compressed air forced into the interposed air channel, for strength and tightness.

The length of the sealing sheet extends from one inspection tunnel to the next tunnel, or, respectively, from the inspection tunnel to the dump edge. The individual sheets run at a right angle to the axis of the inspection tunnel and extend with their end faces into the tunnel by about 5 cm. After testing of the seams, the first flexible sealing barrier is overlaid by a second (upper) layer of flexible sealing sheets with a plane of hollow channels. The laying method corresponds to that for the lower sealing barrier, but the seams should be located so that the seams of the upper sealing sheet are offset with respect to the seams of the lower sealing sheet. All seams are to be tested before further work is started.

Ridge sections are placed as prefabricated elements on the floor sections of the inspection tunnels, or such ridges are cast as poured concrete parts. Between the two parts, the flexible sealing sheets are disposed in two planes, the end faces of the individual sheets extending into the tunnel by 5 cm.

In order to avoid compression of the flexible sealing sheets in the zone of the tunnel wall, the wall stresses are transmitted via brackets into the floor plate. These brackets permit free access to the ends of the hollow channels in the flexible sealing sheets.

Another conventional seal is installed on top of the upper layer of flexible sealing sheets. This conventional seal provides leakproof conditions in the zone of the ridges for the tunnels and preferably extends over the entire base of the rubbish dump. In this case, the flexible sealing sheets of this invention perform merely a control function whereas the upper, conventional sealing layer ensures the actual sealing of the dump. In case of leakage of the uppermost sealing barrier, the sealing sheets of this invention, lying thereunder, act as independent seals with control possibility.

The seams of the uppermost sealing layer must likewise be tested for leakproofing ability. A protective layer protecting the barrier from subsequent damage is placed on this uppermost sealing layer.

The entire sealing barrier, consisting of protective layer, sealing layer, and two flexible sealing sheets with their hollow channels, is provided with an additional protective layer.

In the zone of the tunnel, the barrier is provided with a solid protective stratum, for example, of masonry having a thickness of about 11.5 cm with mortar joints or pressure-resistant building panels. Between the tunnels, the protective layer consists of a sand stratum having a thickness of about 30 cm. A layer of fine solid waste (e.g., household refuse) is applied thereon, this layer having a thickness of at least 50 cm. On top of this fine solid waste layer, the dump material is stored in correspondence with the category of the rubbish dump or waste deposit.

The sealing layer extends between the individual tunnels preferably at a minor inclination (gradient) so that, in case of damage to the sealing layer and to the flexible sealing sheet with hollow channels, dump seepage water (or eluate) can flow along the damage hollow channels into the inspection tunnel. Thus, by the efflux of seepage water into the inspection tunnel, damage to the sealing barrier can be recognized at an early stage so that corresponding repair steps can be initiated. In this connection, the provision is made to introduce into the damaged hollow channels a sealing material, e.g., DYNAGROUT PPN (R) of Dynamit Nobel AG (described in German Patent No. 3,329,403-C 1 Canadian Patent No. 1,223,720), the sealing material being subsequently hardened or set. This sealing material as described in the Canadian Patent is a gel-forming mixture comprising an alkali-metal-silicate, water and one or more trialkoxy silanes of the formula R—$(Si(OR')_3$ as a gelling agent, wherein R is an alkyl group having 1 to 6 carbon atoms and R', which may be the same or different, is an alkyl group of 1 to 4 carbon atoms, and an additive for adjusting the gelling time, gel strength or both; the additive being an acid alkali-metal- or ammonium-phosphate, phosphoric acid or a mixture thereof. In this way, reliable repair of the damaged flexible sealing sheets can be achieved. By means of the hollow channels located in the lower flexible sealing sheet, the success of the repair as well as any possible further damage to the sealing sheet can be determined.

The inspection tunnels, extending preferably with a minor slope, which tunnels are subsequently located underneath the rubbish fill, provide free access to the individual ends of the hollow channels and thus, make it possible to check the dump barrier. In correspondence with the length of the dump, one such inspection tunnel or several such inspection tunnels can be provided. The minor longitudinal slope of the inspection tunnels permits a collection of the leakage water in a pump sump. By way of a float switch, leakages can optionally be directly signaled to a central point. Preferred thermoplastic materials which may be used to produce the flexible sealing (proofing) sheet are chlorinated polyethylene (CPE), polyethylene of low or high density (LDPE, HDPE), polypropylene (PP) or polyvinyl chloride (PVC), especially plasticised PVC with low content of plasticiser.

BRIEF DESCRIPTION OF THE DRAWINGS

The invention will be described in greater detail with reference to the following two examples and to the accompanying drawings wherein.

DETAILED DESCRIPTION OF THE PREFERRED EMBODIMENTS

Example 1

In a first embodiment of the invention, a basin-shaped solid waste dump is constructed. For sealing the dump, i.e. for the liquid-tight separation of the subsequent bulk 3 of the dump (waste) from the ground 6, especially from ground-water, water, a large-area, waterproofing membrane system [flexible barrier layer 1 (FIG. 3)] is provided which consists of several flexible sealing sheets 11 welded together along their longitudinal rims.

The flexible sealing sheets 11 employed are produced in this example from high density polyethylene (HDPE) by extrusion, but other, preferably thermoplastic materials can also be used, especially plasticized polyvinyl chloride (PVC) or chlorinated polyethylene. The choice of material will be made by one skilled in the art based on the respective requirements of the sanitary fill.

Figure 1:
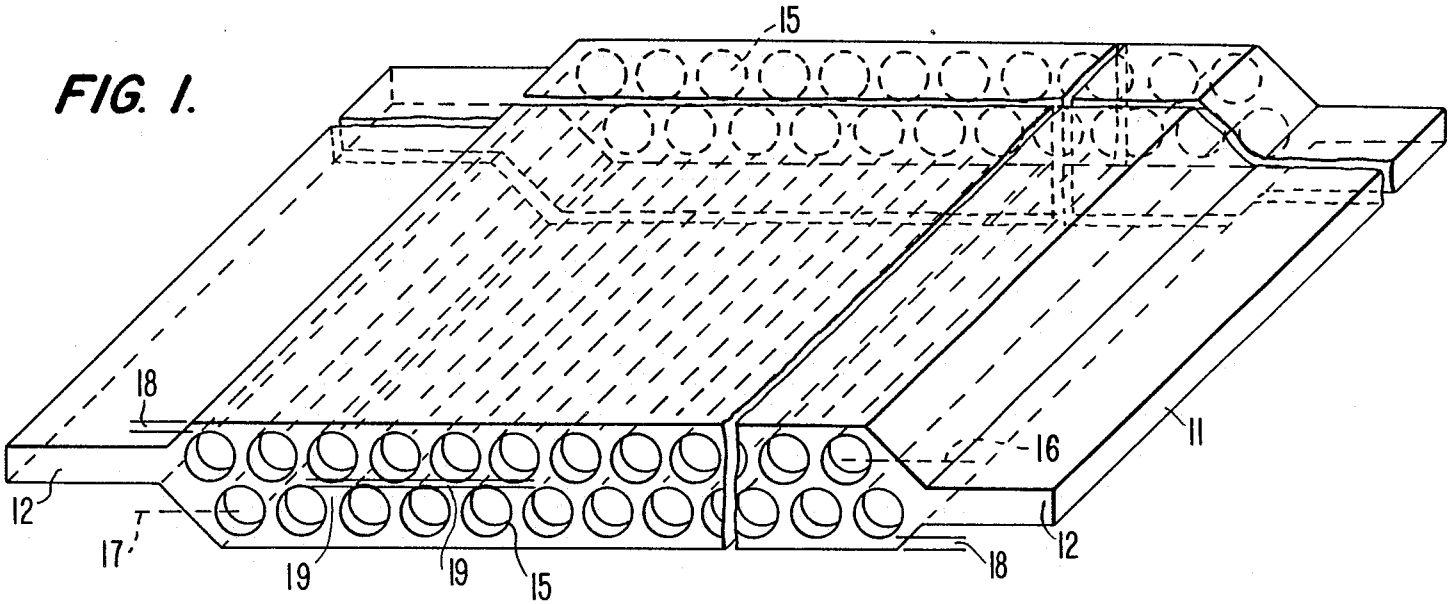
FIG. 1 shows a flexible sealing sheet according to the invention with rows of hollow side-by-side channels arranged in two parallel planes.

In this example, the dimensions of the individual flexible sealing sheets 11 are in each case 60 m×2m×12 mm (length×width×height). The flexible sealing sheets 11 utilized exhibit along each of their longitudinal rims respectively a strip 12 devoid of cavities and having a width of about 5 cm and a thickness of about 3 mm (as shown in FIG. 1).

The flexible sealing sheet 11 has in this example, round (tubular) hollow channels 15 arranged in rows in two planes 16, 17 (strata). The diameter of the individual hollow channels 15 amount to about 5 mm; the lateral distance of the hollow channels 15 from one another is 6 mm, so that the minimum channel wall thickness is 1 mm.

The hollow channels 15 of the individual planes 16, 17 are preferably arranged offset with respect to one another to achieve maximum strength of the sealing sheet with minimum use of material. At the same time, this feature ensures that in the case of a possible damage to the sealing sheet 11, at least one of the hollow channels 15 is definitely penetrated before a through connection is established between the bulk 3 of the sanitary fill and the subsoil 6.

The flexible sealing sheet 11 has in this example on each side, respectively, one layer 18 which is free of cavities and has a thickness of at least 1 mm. These layers 18 devoid of cavities form—as viewed with respect to their function—together with the central layer 19 constituted by the hollow channel walls a triple-ply seal with interposed hollow channel layers corresponding to planes 16, 17 (FIG. 1).

Figure 2:
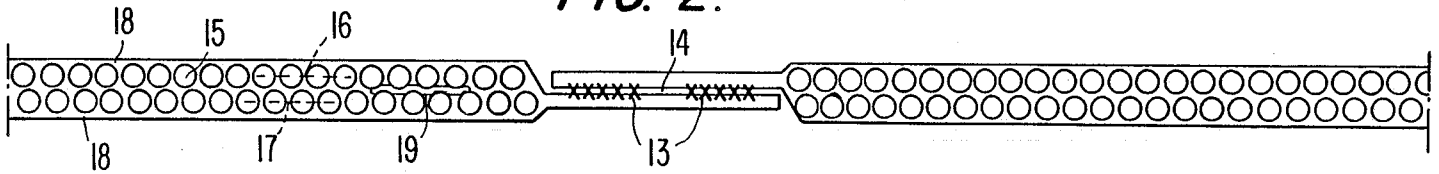
FIG. 2 shows a seam joint of two flexible sealing sheets in a cross-sectional view.

When laying the flexible sealing sheets 11 on the prepared ground 6, the sheets are spread out with their lateral strips 12 overlapping and are thermally welded together (as shown in FIG. 2). During this step, the surfaces are heated up to the liquid point of the material, i.e. make molten, and bonded under pressure. This welding procedure takes place preferably in the form of a double seam 13. This creates the possibility of testing the bond for strength and leakproof property with the aid of compressed air forced into the intermediately located air channel 14.

Figure 3:
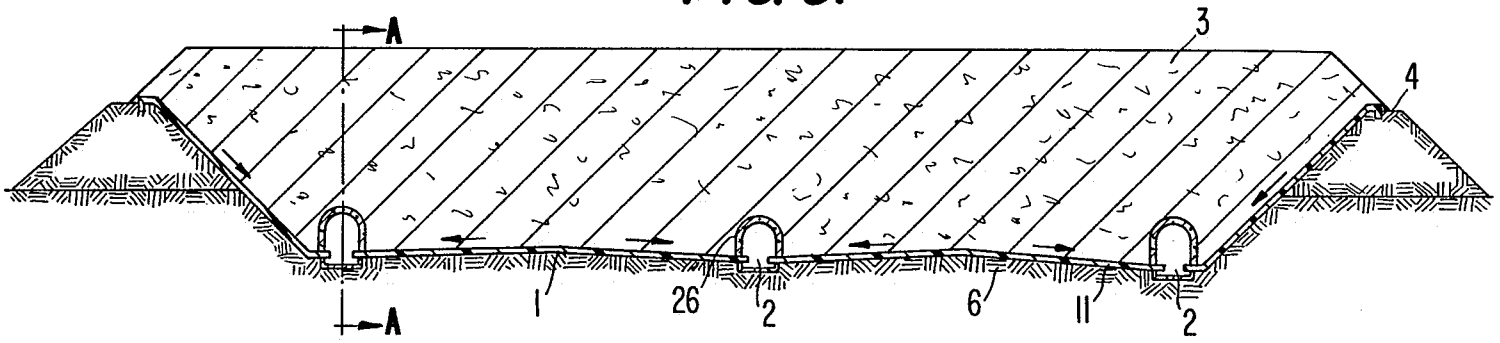
FIG. 3 shows a longitudinal section through a solid waste dump sealed in accordance with this invention.
Figure 4:
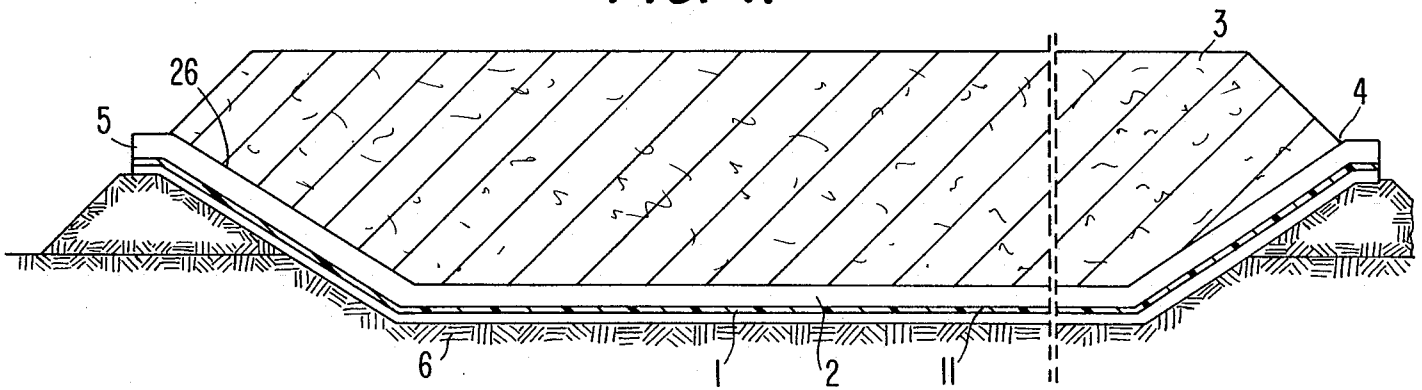
FIG. 4 is a section through the solid waste dump of FIG. 3 along line A—A.

In the embodiment, in correspondence with the length of the flexible sealing sheets 11 employed, an inspection tunnel 2 is provided about every 60 meters, the sealing sheets 11 terminating in this tunnel with their open end faces (FIG. 3, FIG. 4). The inspection tunnels 2 extend substantially in parallel, i.e. at a mutual spacing of about 60 m, and run at both ends up to the edge 4 of the fill (FIG. 4). The tunnels are accessible from the portals 5 and the seal can thus be checked for leakage.

Figure 5:
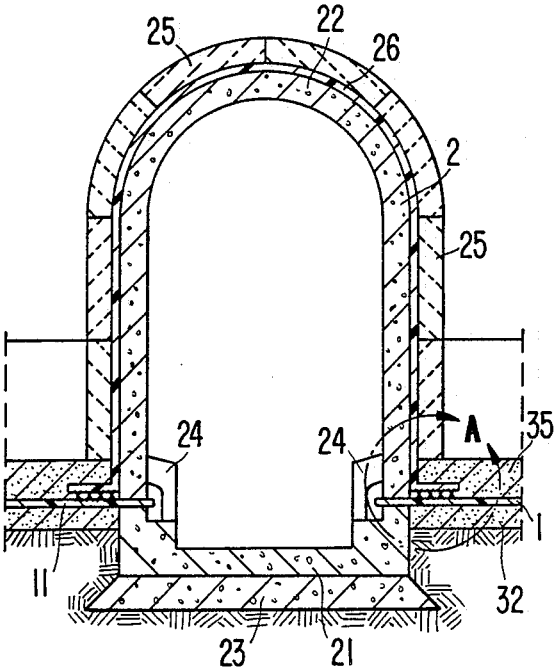
FIG. 5 shows an inspection tunnel in a cross-sectional view.

The tunnels 2 are composed of prefabricated concrete parts and consist of a floor section 21 and a ridge section 22 (FIG. 5). The floor section is placed on a poured-concrete foundation 23. Between the two prefabricated concrete parts 21 and 22, the flexible sealing barrier 1 is disposed; the end faces of the individual flexible sealing sheets 11 projecting into the tunnel 2 by about 5 cm. In order to avoid compression of the flexible sealing sheets 11 in the zone of the tunnel wall (resulting of possible closing of the channels 15), the wall stresses are transmitted via brackets 24 into the floor plate 21. These brackets permit free access to the ends of the hollow channels 15 of the sealing sheets 11.

The flexible sealing sheet 11 is interrupted in the zone of the inspection tunnels 2. For this reason, the inspection tunnel must be provided separately with a polymeric seal 26. This seal is based on the same basic material as the sealing sheets 11 and is permanently joined to the latter in a liquid-tight fashion in the fillet zone 33. In the zone of the tunnel 2, the seal 26 is provided with a solid protective layer 25, for example, made up of masonry of a thickness of 11.5 cm with mortar joints, or pressure-resistant building panels.

Figure 6:
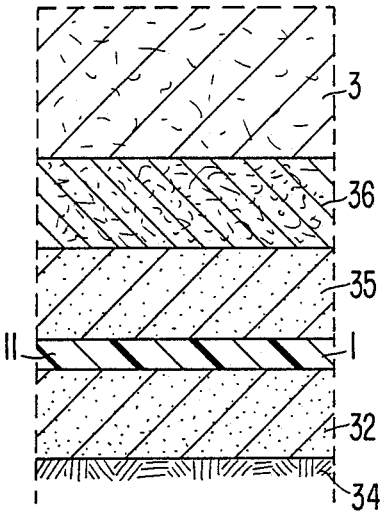
FIG. 6 shows the layered structure of a dump.
Figure 7:
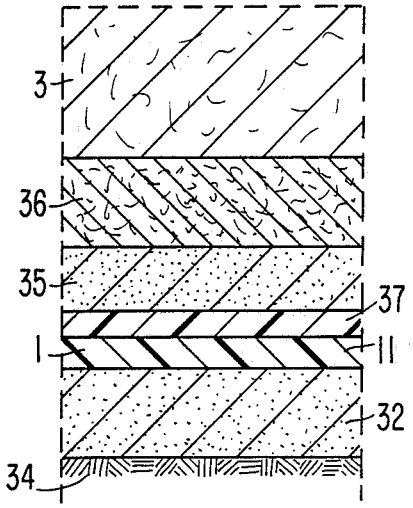
FIG. 7 shows an alternative layered structure of a dump.

Between the tunnels, the barrier consists of a supportive layer 32 of sand having a thickness of 10 cm which comes to lie directly above the subgrade 34 (FIG. 6, FIG. 7). The flexible sealing barrier 1 is laid on the compacted supporting layer 32 by unrolling and liquid-tight welding together of the individual flexible sealing sheets 11. The sealing layer 11 is followed toward the top by a protective layer 35 of sand having a thickness of 30 cm. On this protective layer, a layer of fine solid waste (e.g. domestic waste) 36 is applied, having a thickness of at least 50 cm. Above this fine solid waste layer, the dumping material 3 is deposited in correspondence with the fill category (FIG. 6).

As an alternative of the above, in case of greatly burdened dumps, an additional sealing barrier can be utilized (FIG. 7). The structure corresponds essentially to that of FIG. 6, but above the sealing layer 11, a second sealing layer 37 is arranged. The latter can preferably consist of a high-polymeric sealing sheet or also of a mineral layer (clay).

Figure 8:
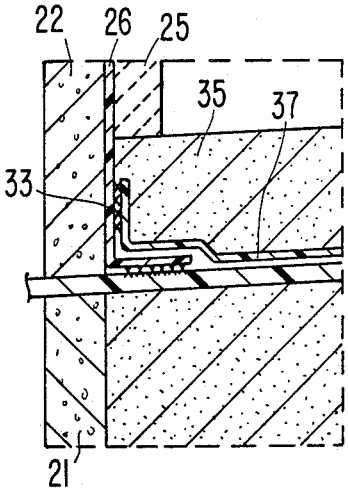
FIG. 8 shows detail A according to FIG. 5 with an additional sealing barrier.

In case of a synthetic resin barrier, the latter extends up to the inspection tunnel and is here joined in a fluid-tight fashion to the seal 26 (FIG. 8).

Between the individual tunnels 2, the flexible sealing barrier 1 preferably extends at a minor gradient so that in case of damage to the sealing barrier 1, dump seepage water or eluate can flow along the damaged hollow channels 15 into the inspection tunnel 2. Thus, by the efflux of seepage water into the inspection tunnel 2, damage to the sealing barrier 1 can be identified at an early point in time so that appropriate repair measures can be taken. For this purpose, the provision is made, for example, to introduce a sealing compound or hardenable material into the damaged hollow channels, which compound subsequently hardens or sets. In this way, a reliable repair of the damaged sealing barrier 1 can be accomplished. By means of the hollow channels located in the bottom plate, the success of the repair as well as any possible further damage to the sealing barrier 1 can be determined.

Example 2

Figure 11:
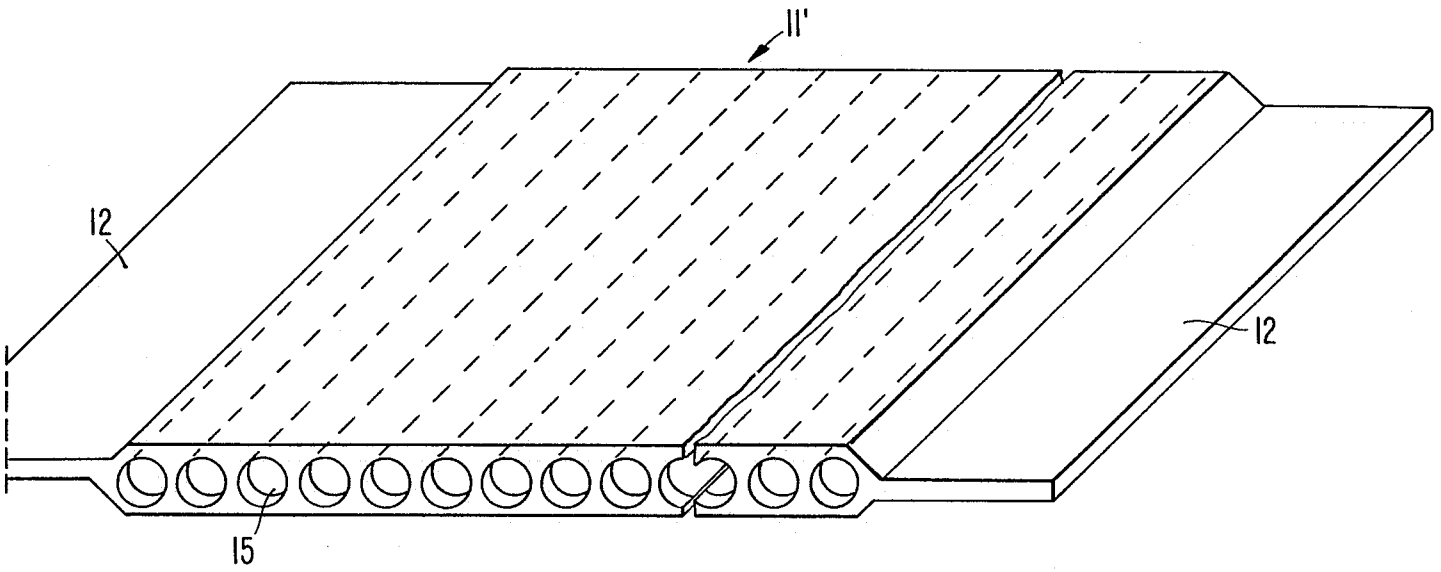
FIG. 11 shows a flexible sealing sheet of this invention, having a row of hollow channels arranged in a single plane.

In a further example, a sanitary fill is sealed by means of flexible sealing sheet 11' of this invention which exhibits only one plane of hollow channels (FIG. 11).

Figure 9:
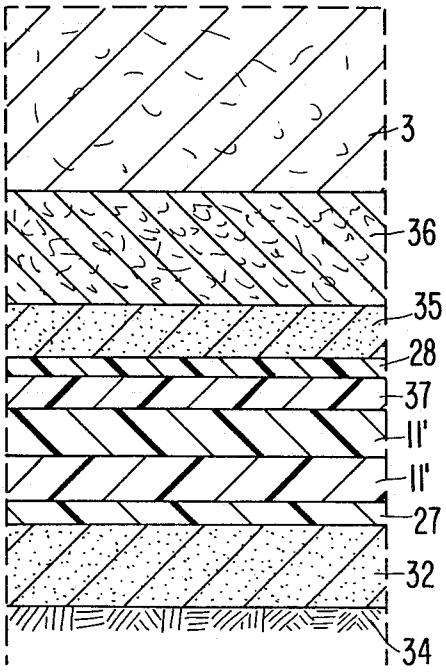
FIG. 9 shows a stratified structure of a dump according to Example 2.

The mode of operation corresponds extensively to that of Example 1, except that another stratification of the sealing sheet 11' is utilized in accordance with FIG. 9.

The pit for the subsequent dump is excavated in a basin-like fashion. In the throat region between the floor and the slope and optionally on the floor, the inspection tunnels 2 extend substantially in parallel, i.e. at the spacing of about 60–100 meters, and they are continued with both ends up to the edge 4 of the dump. The inspection tunnels 2 can be entered later on through the portals 5, and the barrier can be checked by leakage.

The bottom parts 21 of the inspection tunnels 2 are cast onto the subgrade 34, for example, using poured concrete. Between the tunnels 2 and in the zone of the slopes, a supporting layer 32 is applied, compacted, and graded. This layer is followed by a protective layer 27, for example, a protective mat. The ends of the protective layer 27 terminate respectively at the wall of the inspection tunnel. The mat strips 27 overlap one another by at least 5 cm.

A lower flexible sealing sheet 11 corresponding to that shown in FIG. 11, is laid on top of the protective layer 27. During this step, the sheets are spread out with their lateral strips 12 overlapping and are welded together thermally. During the welding process, the surfaces are heated up to the flow limit of the material and bonded under pressure. This welding procedure is preferably effected in the form of a double seam. This provides the possibility of testing the bond for strength and tightness with the aid of compressed air forced into the interposed air channel.

The length of a sealing sheet 11' extends from one inspection tunnel 2 to the next inspection tunnel 2, or from the inspection tunnel 2 to the edge 4 of the dump (as shown in FIGS. 3 and 4). The individual sheets extend at a right angle to the axis of the inspection tunnel and project with their end faces into the tunnel 2 by about 5 cm.

After testing the seams, a second flexible sealing sheet 11' comes to lie on top of the lower sealing sheet 11. The laying method corresponds to that of the lower sealing sheet 11', but the seams of the upper sealing sheet 11 should be arranged offset with respect to the seams of the lower sheet. All of the seams are to be checked before further work is begun.

Figure 10:
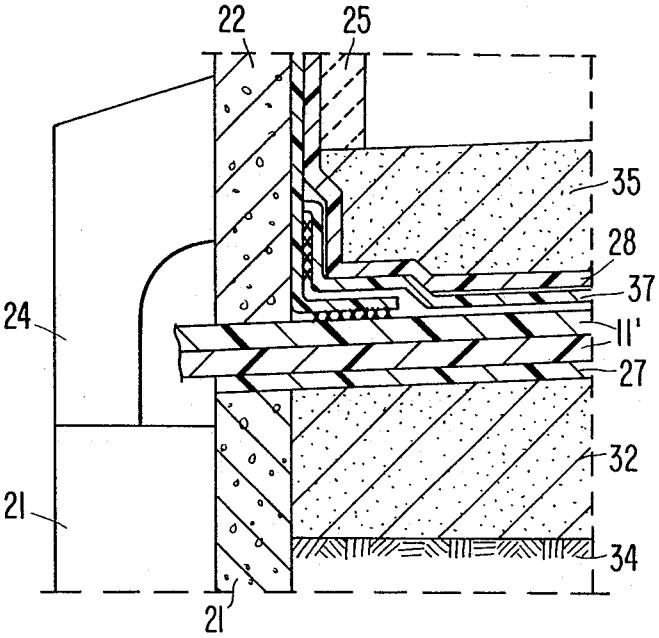
FIG. 10 shows the connection of the seal at the inspection tunnel according to Example 2.

The ridge parts 22 of the tunnels are placed in the form of prefabricated parts onto the floor parts 21 of the inspection tunnels 2, or they are cast as poured concrete. Between these two parts, the flexible sealing sheets 11' are disposed, the end faces of the individual sheets projecting by about 5 cm into the tunnel (as shown in FIG. 10).

In order to avoid compression of the flexible sealing sheets 11' in the zone of the tunnel wall, the wall stresses are transmitted via brackets 24 into the floor plate 21. These brackets 24 permit free access to the ends of the hollow channels 15 of the sealing sheets 11'.

Another conventional barrier 37 is installed on top of the sealing sheets 11'. This barrier seals the tunnel 2 in the zone of the ridges 22 and extends over the entire base of the dump. The seams of this barrier must likewise be tested for leakproofing ability. This conventional sealing barrier is covered by an additional protective layer 28 protecting the barrier 37 from subsequent damage.

The entire sealing barrier, consisting of the protective layer 28, the sealing barrier 37, and the flexible sealing sheets 11' is provided with a protective layer 35. In the zone of the tunnel, the barrier is equipped with a solid protective layer 25, for example, of masonry having a thickness of 11.5 cm, with mortar joints, or of pressure-resistant building panels.

Between the tunnels, the protective layer 35 consists of a sand layer having a thickness of 30 cm. The sand layer is topped by a layer of fine solid waste 36 (for example, domestic refuse) having a thickness of at least 50 cm. Above this fine waste layer, the dump material 3 is deposited in accordance with fill category.

Between the individual tunnels, the sealing barrier extends preferably at a slight slope so that in case of damage to the sealing barrier 37 and the upper flexible sealing sheet 11', dump seepage water, e.g. eluate, can flow along the damaged hollow channels 15 into the inspection tunnel 2. By means of the efflux of seepage into the inspection tunnel 2, it is thus possible to recognize at an early point in time any damage to the sealing barrier so that appropriate repair measures can be taken. In this connection, the provision is made to introduce a sealing compound, especially in accordance with German Patent No. 3,329,403-C 1, into the damaged hollow channels; this sealing compound subsequently hardens or sets. In this way, a reliable repair of the damaged sealing barrier can be effected. On account of the hollow channels 15 located in the lower flexible sealing sheet 11, the success of the repair as well as any possible further damage to the sealing sheet can be detected. The inspection tunnels 2 which extend preferably at a slight slope and are subsequently located underneath the dump provide free access to the individual planes of the hollow channels and thus, control of the dump barrier. Depending on the length of the dump, one or several such inspection tunnels can be provided. The slight longitudinal slope of the inspection tunnels permits the collection of leakage water in a pump sump. By means of a float switch, leakages can be signaled directly to the central station.

What is claimed is:

1. A flexible sealing sheet for controllable leakproof separation of regions present on both sides of the sheet, characterized in that the sealing sheet exhibits, in at least one plane, a plurality of hollow tubular channels extending essentially in the longitudinal extension of the sheet and being separated from one another by channel walls and in that the sealing sheet exhibits on both sides an impervious layer devoid of hollow spaces.

2. A flexible sealing sheet according to claim 1, characterized in that the sealing sheet exhibits, in at least two planes, hollow tubular channels extending essentially in the longitudinal extension of the sheet and being separated from one another by channel walls.

3. A flexible sealing sheet according to claim 1, characterized in that the sheet exhibits on both longitudinal rims respectively one lateral strip devoid of hollow channels, for the fluid-tight connection of several sealing sheets.

4. A flexible sealing sheet according to claim 2, characterized in that the sheet exhibits on both longitudinal rims respectively one lateral strip devoid of hollow channels, for the fluid-tight connection of several sealing sheets.

5. A flexible sealing sheet according to claim 1, characterized in that the sheet exhibits on both sides respectively one layer devoid of channels and having a thickness of at least 0.5 mm.

6. A flexible sealing sheet according to claim 1, characterized in that the sheet is produced in one piece by extrusion of a thermoplastic synthetic resin.

7. A flexible sealing sheet according to claim 1, characterized in that the sheet consists of a thermoplastic synthetic resin.

8. A flexible sealing sheet according to claim 1, characterized in that the hollow tubular channels have a round cross section with a diameter of 2–10 mm.

9. A flexible sealing sheet according to claim 1, characterized in that the hollow tubular channels have a round cross section with a diameter of 4–6 mm.

10. A flexible sealing sheet according to claim 1, characterized by total thicknesses of 5–12 mm in case of a flexible sealing sheet exhibiting hollow tubular channels in one plane, and by a total thickness of 10–15 mm in case of a sealing sheet exhibiting hollow tubular channels in two planes.

11. A flexible sealing sheet according to claim 1, wherein said hollow tubular channels are separated from exterior surfaces of the sheet by channel walls.

12. A flexible sealing sheet according to claim 1, wherein said hollow tubular channels extend continuously from one end of the sheet to the other end of the sheet to allow the passage of fluid therethrough.

13. A method for controllably leakproof separation of regions present on both sides of a plurality of flexible sealing sheets joined together along longitudinal edges to form a sealing barrier, each of said flexible sealing sheets comprising in at least one plane a plurality of hollow tubular channels extending essentially in the longitudinal extension of the sheet and separated from one another by channel walls and on both sides of the channels, an impervious layer devoid of hollow spaces, which comprises positioning the plurality of sealing sheets adjacent to at least one appropriately horizontal inspection galley providing a leakproof seal between an inspection galley and end portions of the plurality of flexible sealing sheets, said plurality of sealing sheets being positioned to terminate with at least one of their ends along end faces in the approximately horizontal inspection galleys whereby open ends of the individual hollow tubular channels of each of the flexible sealing sheets becomes freely accessible and inspectable from within an inspection galley.

14. A barrier system for waterproofing rubbish dumps which comprises at least one sealing sheet of thermoplastic synthetic resin having in at least one plane, a plurality of hollow tubular channels extending essentially in the longitudinal direction of the sheet and being separated from each other by channel walls and having impervious outer resin layers extending on upper and lower sides of the sheet, said outer resin layers being free of cavities and being joined to a lateral strip extending in a longitudinal direction of said sheet and adapted to be bonded to a lateral strip of an adjacent sealing sheet, and at least one inspection tunnel arranged perpendicular to the longitudinal direction of the at least one sealing sheet, open ends of the channels terminating within said tunnel and being freely accessible.

15. A flexible sheet for the controllable leakproof separation of regions present on both sides of the sheet, said sealing sheet comprising, in at least one plane, a plurality of hollow tubular channels extending essentially in the longitudinal extension of the sheet and being separated from one another by channel walls and said sheet further comprises impervious outer resin layers extending on upper and lower sides of the plurality of hollow tubular channels within the sheet, said outer resin layers being free of cavities and being joined to a lateral strip extending in a longitudinal direction of said sheet, said outer resin layers and said channel walls being formed of the same resin material.

16. A flexible sealing sheet according to claim 15, wherein the sheet is produced in one piece by extrusion of a thermoplastic synthetic resin.

* * * * *